US008347841B1

(12) United States Patent
Pelfrey

(10) Patent No.: US 8,347,841 B1
(45) **Date of Patent: *Jan. 8, 2013**

(54) INTERNAL COMBUSTION ENGINE

(75) Inventor: Riley Dale Pelfrey, St. Petersburg, FL (US)

(73) Assignee: R. Dale Pelfrey, Dayton, OH (US), Trustee of the R. Dale Pelfrey Trust ( * ) Notice: Subject to any disclaimer, the term of this patent is extended or adjusted under 35 U.S.C. 154(b) by 0 days.

This patent is subject to a terminal disclaimer.

(21) Appl. No.: 13/433,855

(22) Filed: Mar. 29, 2012

Related U.S. Application Data

(63) Continuation-in-part of application No. 13/242,213, filed on Sep. 23, 2011, now Pat. No. 8,151,755.

(51) Int. Cl.
*F01L 7/00* (2006.01)

(52) U.S. Cl. ..... 123/190.5; 123/80 BA; 123/190.15; 123/65 SP

(58) Field of Classification Search .... 123/190.4–190.9, 123/190.11, 190.15, 80 R, 80 BA, 65 SP
See application file for complete search history.

(56) References Cited

U.S. PATENT DOCUMENTS

| | | | |
|---|---|---|---|
| 1,476,359 | A | 12/1923 | Ford |
| 1,492,587 | A | 5/1924 | Toth |
| 1,924,188 | A | 8/1933 | Hall |
| 2,787,988 | A | 4/1957 | Joseph |
| 4,119,077 | A | 10/1978 | Vallejos |
| 5,878,707 | A | 3/1999 | Ballard |
| 5,996,544 | A | 12/1999 | Bartos |
| 6,205,960 | B1 | 3/2001 | Vallejos |
| 6,308,677 | B1 | 10/2001 | Bohach et al. |
| 6,694,942 | B1 | 2/2004 | Massmann et al. |
| 6,976,464 | B2 | 12/2005 | Crall |
| 7,140,342 | B1 | 11/2006 | Murray |
| 7,650,869 | B2 | 1/2010 | Slemp |
| 7,779,795 | B2 | 8/2010 | Warren |

OTHER PUBLICATIONS

Article: AET Bishop Rotary Valve—2007 Issue of Auto Technology Magazine.

*Primary Examiner* — Noah Kamen
(74) *Attorney, Agent, or Firm* — R. William Graham

(57) ABSTRACT

An internal combustion engine includes a rotary valve such that said rotary valve serves as an output shaft for said engine.

38 Claims, 18 Drawing Sheets

SECTION A-A

SECTION A-A

SECTION A-A

SECTION A-A

SECTION A-A

SECTION A-A

SECTION C-C

SECTION 8-8

4 cycle piston stroke
and cylinder pressure
Note:
pressure curve is without combustion
t1
t2
t3
t4
t5
Intake
Compression
Combustion
Exhaust
TDC
Stock engine
+Prototype
stroke
Pressure
piston stroke
0 psi
BDC
0
90
180
270
360
450
540
630
720
crank shaft rotation (degrees)

VIEW D-D

VIEW E-E

SECTION F-F

SECTION G-G

INTERNAL COMBUSTION ENGINE

This is a continuation-in-part of U.S. Ser. No. 13/242,213 filed Sep. 23, 2011 now U.S. Pat. No. 8,151,755.

BACKGROUND OF INVENTION

1. Field of the Invention

This invention relates to internal combustion engines, and more particularly to an improvement in engines of the type employing a rotary valve which feeds laterally disposed cylinders and pistons.

2. Prior Art

The internal combustion engine of the present invention differs in significant regard from prior conventional internal combustion engines of the two stroke cycle and four stroke cycle types. However, certain terminology developed with reference to such previously known engines is of value in clarifying the operation of the engine of this invention.

The motion of a piston operatively connected to a crankshaft has given rise to such terminology as "top dead center" (TDC) and "bottom dead center" (BDC) positions of a piston. Top dead center position refers to a position of the piston, connecting rod and crankshaft in which the axis of rotation of the crankshaft and the axis of pivotal connection of the connecting rod with the piston and the crankshaft are aligned while the piston is at its furthest distance from the center of the rotation of the crankshaft. Bottom dead center is the position in which the axis of rotation and pivotal movement are aligned while the piston is in its position of most close approach to the center of rotation of the crankshaft. Another term used in a conjunction with conventional internal combustion engines is "displacement" meaning the volume swept by a piston in one stroke.

Prior engines are described hereinafter. U.S. Pat. No. 6,205,960 issued March 2001 discloses an engine wherein air passes through the center of the shaft. Exhaust and intake air paths are through opposite ends of the shaft. A common crank is at center of the cylinder. U.S. Pat. No. 7,140,342 issued November 2006 discloses an engine in which air passes radially across the rotary valve constructed of 2 collinear tubes. Separate air paths exist for intake and exhaust.

U.S. Pat. No. 4,119,077 issued October 1978 shows rotating valve porting concept. U.S. Pat. No. 7,779,795 issued August 2010 shows a rotary cylinder sleeve and flap cylinder side valve.

While there have been many improvements in the internal engine, there remains a need for more efficient and powerful engine. Further, improvements of flow intake and combustion efficiency are needed.

SUMMARY OF THE INVENTION

It is an object to improve the internal combustion engine. It is another object to increase the aforesaid efficiencies of an internal combustion engine.

It is another object to improve the performance of the internal combustion engine.

It is yet another object to improve rotary valve engines by providing the rotary valve end to serve as the engine drive shaft.

It is a further object to improve rotary valve engines by rendering it common to all cylinders thereby reducing the time between intake opening, creating a near continuous flow.

A further object is to provide a rotary engine with unique port geometry.

Still another object is to provide a rotary engine which is configured to create a vacuum at a port using a centripetal effect to improve exhaust air flow.

Yet another feature is provide a rotary engine which is configured with an intake flow path to create pressure using a centrifugal effect which in turn provides a boost effect to the engine.

Another object is to provide a rotary engine having multiple cylinder banks.

A further object is provide a rotary engine with reduced moment of inertia by employing a unique configuration having multiple cylinder banks.

Accordingly, the present invention is directed to an internal combustion engine which is intended to accomplish the aforesaid objectives. The improvements of such engine include:

a cylinder block having at least one cylinder tangentially disposed to and communicating with a transfer port;

a spark plug operably disposed in the cylinder adjacent the transfer port;

a rotary valve surface in communication with the transfer port and wherein the cylinder is laterally disposed to the rotary valve surface;

a rotary valve having a first end, a central portion and a second end, wherein the central portion is rotatably disposed within the rotary valve surface and has an intake port and an exhaust port to supply fuel to and remove exhaust gas from the cylinder through the transfer port, the intake port and exhaust port communicate through the respective first end and second end of the rotary valve to the transport port upon rotation of the rotary valve, the central portion of the rotary valve serves as a flywheel;

at least one piston reciprocally disposed within the cylinder;

a crank case operably disposed adjacent the cylinder having a crank shaft receiving surface; and a crank shaft operably disposed in the crank case, the crank shaft operably connected to the piston by a connecting rod and the crank shaft operably connected to at least one end of the rotary valve such that the rotary valve provides an output shaft for the engine.

In a preferred configuration of there are a plurality of cylinders can preferably include two sets of opposed piston cylinders aligned generally tangent to the rotary valve. A first set of piston cylinders can generally share a common plane through their center axis and are in an offset relation to a second set of piston cylinders which generally share a common plane through their center axis. This arrangement enables connecting rods to cooperatively connect to crank shaft and operate pistons in the cylinders. In this case, a plurality of crank shafts are operably connected to the ends and of the rotary valve to effect the transfer of power.

Other objects and advantages will be readily apparent to those skilled in the art upon viewing the drawings and reading the detailed description hereafter.

DETAILED DESCRIPTION OF PREFERRED EMBODIMENT

Figure 1:
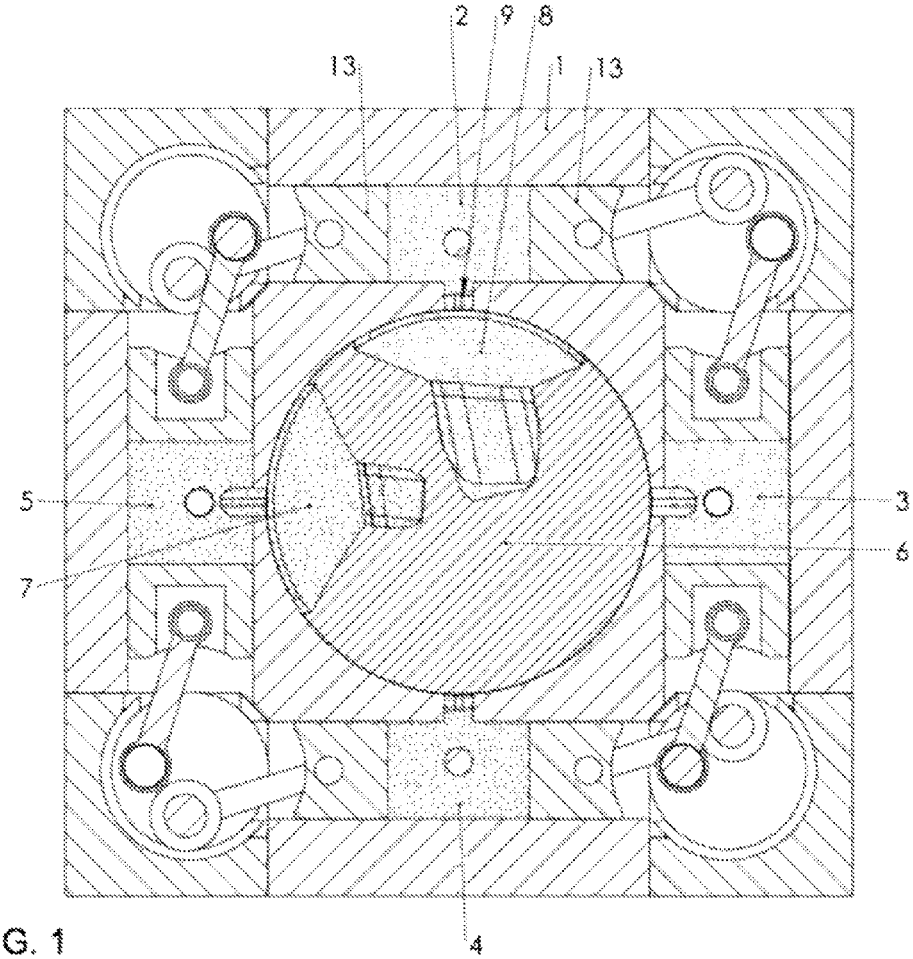
FIG. 1 shows a sectional diagram representing pistons operating in their respective phase cycle at time t1.
Figure 2:
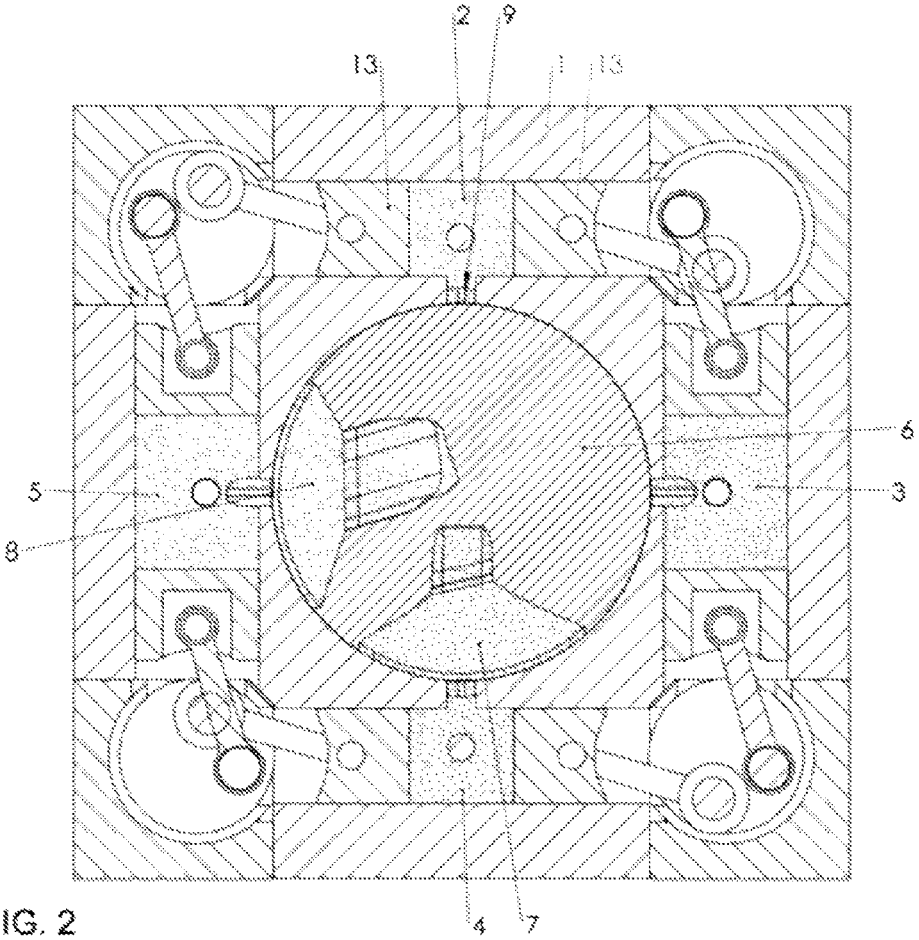
FIG. 2 shows a sectional diagram representing pistons operating in their respective phase cycle at time t2.
Figure 3:
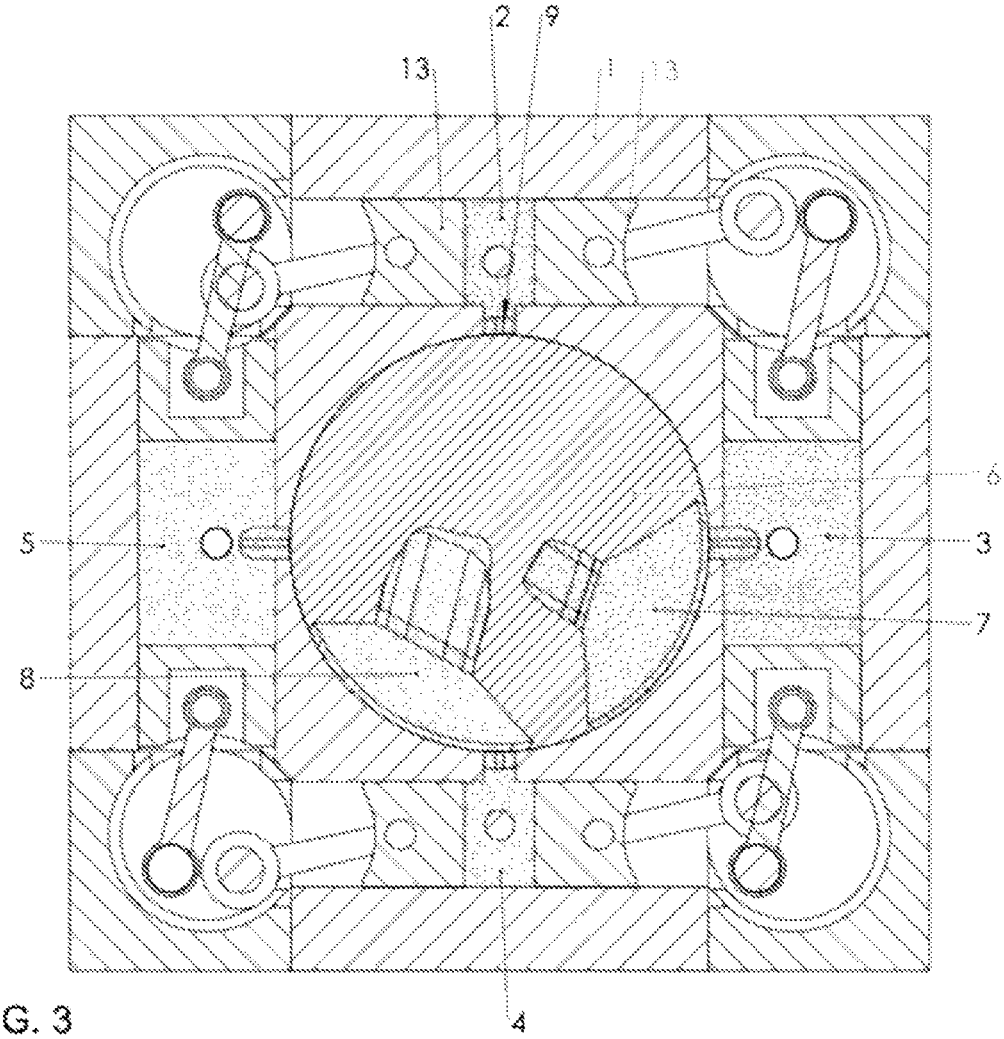
FIG. 3 shows a sectional diagram representing pistons operating in their respective phase cycle at time t3.
Figure 4:
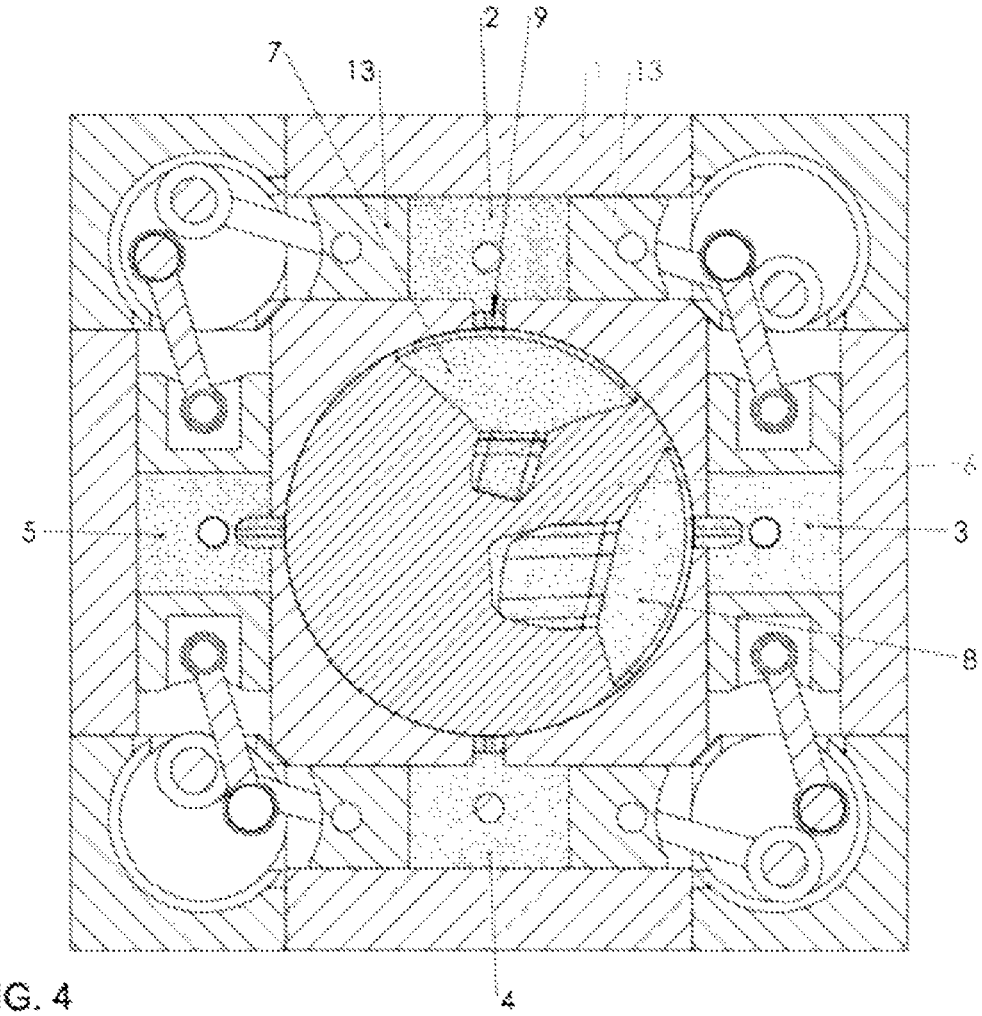
FIG. 4 shows a sectional diagram representing pistons operating in their respective phase cycle at time t4.
Figure 5:
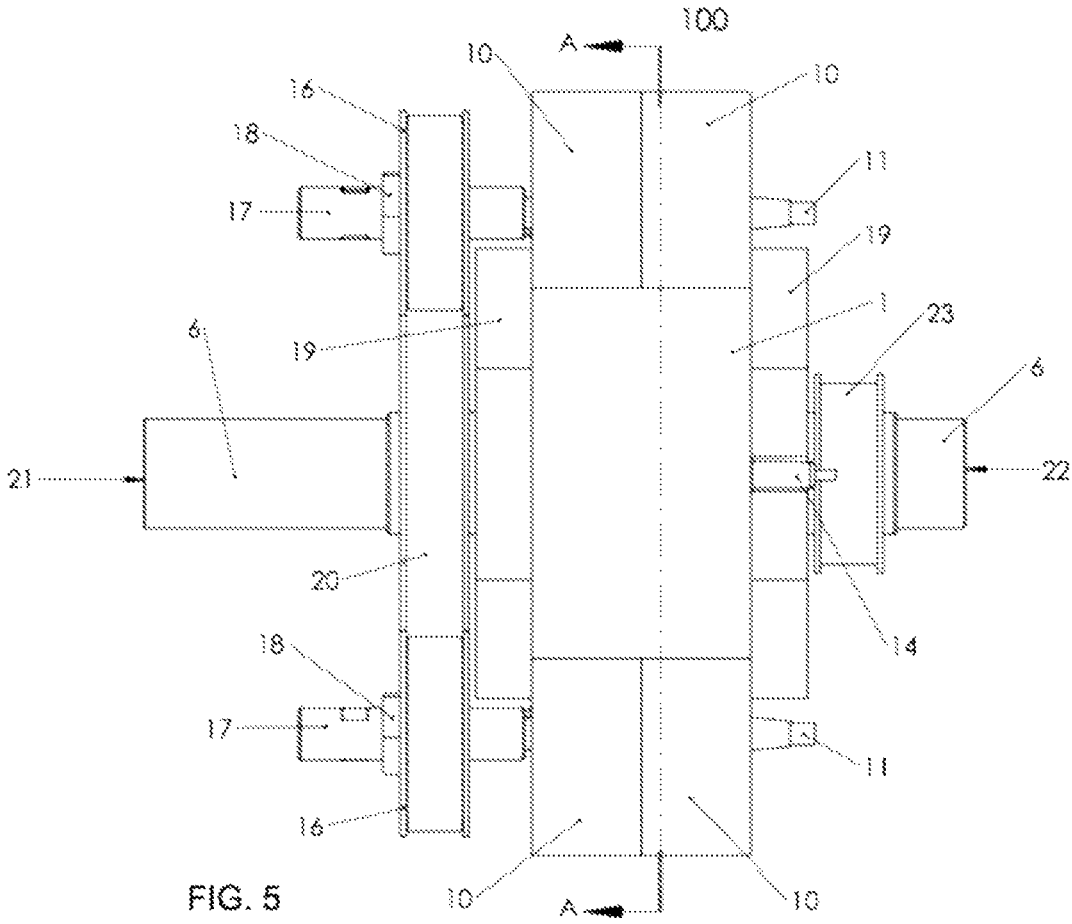
FIG. 5 is a side elevation view of the invention.

Referring now to the drawings, an improvement to the internal combustion engine of present invention is represented by the numeral 100. The invention may also be referred to herein after as "improvements" 100 of the internal combustion engine. The following description in conjunction with viewing the drawings will aid in understanding the present invention. The structure and operation are as follows.

The improvements over co-pending application Ser. No. 13/242,213 includes a common intake and exhaust rotary valve that is centrally located to supply multiple cylinders. The intake and exhaust are supplied from opposition ends of the rotary valve to a common port on each of the cylinders. The rotary valve also serves as the output shaft of the engine. The size of the valve also serves as a flywheel.

One configuration of the cylinders on this design includes four opposed piston cylinders aligned tangent to the rotary valve. A port into each cylinder is located at the top of a piston stroke. This does not limit the possibility of more or less cylinders or other alignments of cylinders. The cylinders are aligned radially to the rotary valve.

A benefit to a common valve is that the air intake would be a near constant flow as it transitions from one cylinder to the next. This will reduce the reverberation generated with a valve closing. The engine can be 2-cycle or 4-cycle configuration.

The features of the 2-cycle configuration is that in most 2-cycle configurations the exhaust port is last to close on the cycle. This allows fresh air to escape through the exhaust and requires a tuned exhaust pipe to operate. A 2-cycle engine also receives a charge of air from the crank case compression.

The instant invention improvement provides a supercharger to enable the needed pressure for the short opening time. It is contemplated that through the configuration of the invention, the intake valve path can generate a centrifugal force that will generate positive pressure to the intake path of the rotary valve.

In this regard, the intake and exhaust valve ports 7 and 8 can preferably be configured with an arcuate shape which is curved in a complementary direction to foster air flow through the ports 7 and 8, such as a trapezoidal shape where air flows through the curve section of the valve 6 which will reduce the flow losses that are common to a round configuration. The outer radius on the curved port 8 is small which increased the flow on the outer wall to match the longer distanced the air mass travels versus the inter wall distance.

Figure 12:
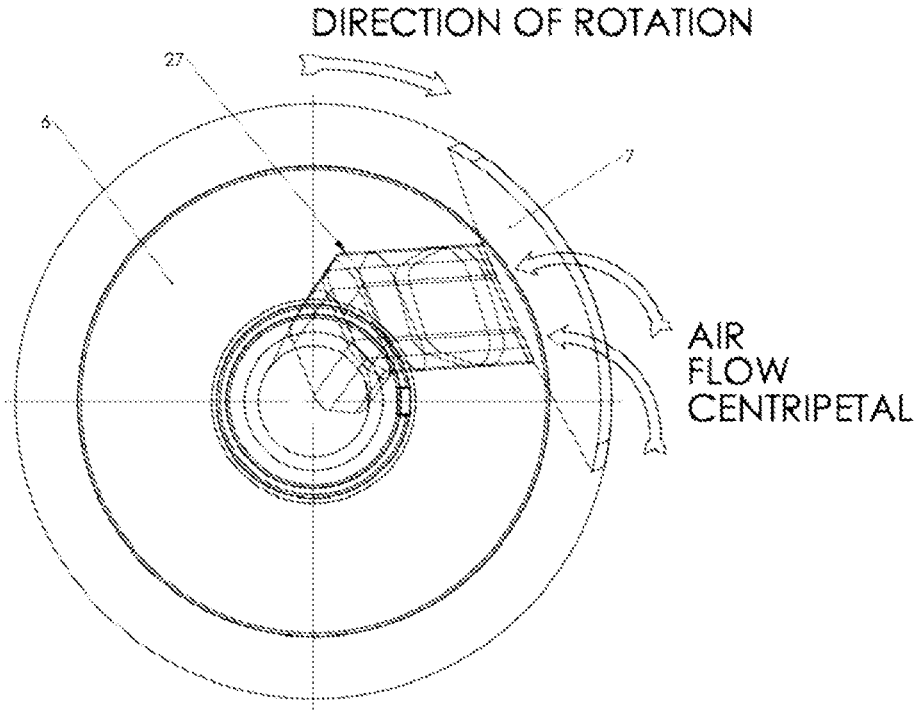
FIG. 12 is a sectional view of the rotary valve showing directional rotation and centripetal air flow with respect to an exhaust port.

The exhaust path of the instant invention is designed to create a vacuum at the outer circumference of the rotary valve 6. The shape of the path creates a centripetal flow away from the circumference to the center of the shaft (rotary valve 6). The air will exhaust out through the shaft (rotary valve 6) as depicted in FIG. 12.

Figure 13:
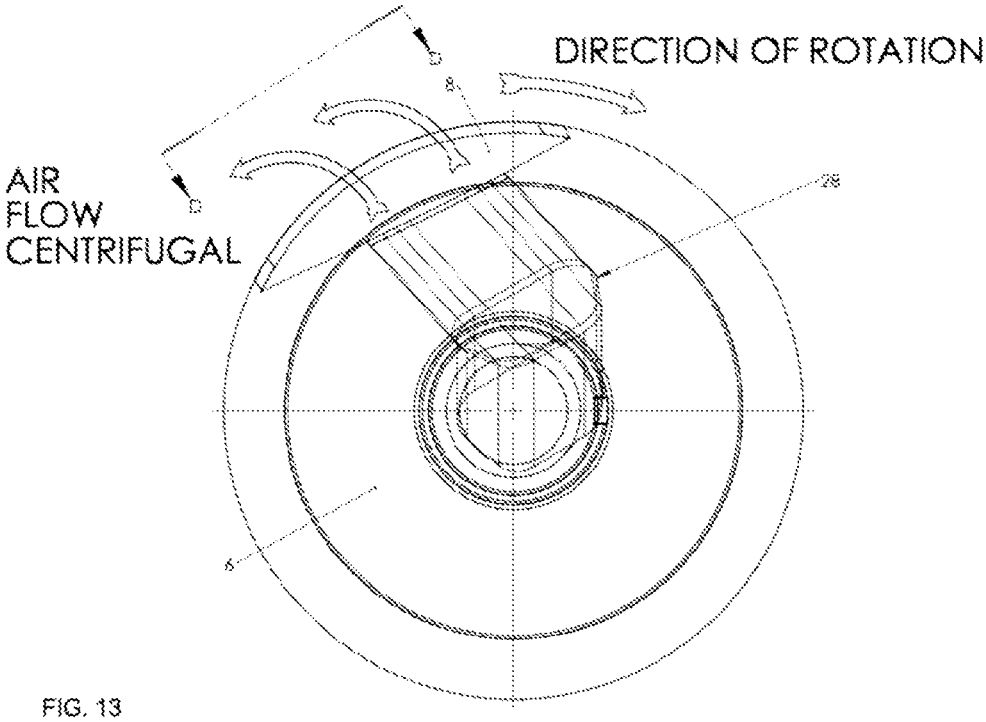
FIG. 13 is a sectional view of the rotary valve showing directional rotation and centrifugal air flow with respect to an intake port.
Figure 14:
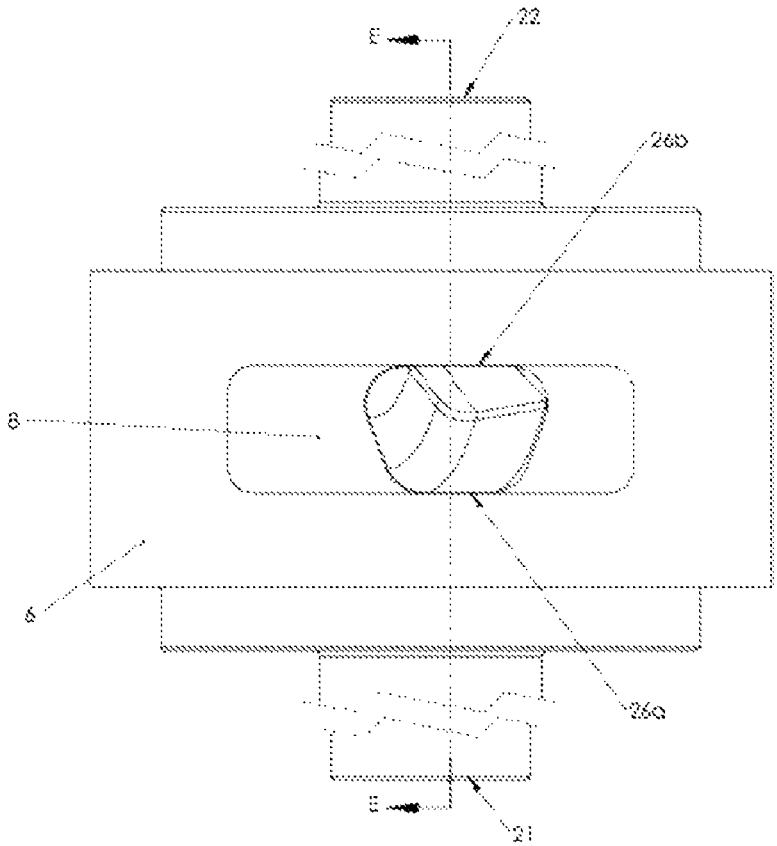
FIG. 14 is a side elevation view of the rotary valve of the invention depicting the intake port taken from the perspective of line D-D of FIG. 13.

Also, the intake path is designed to create pressure at the outer circumference of the rotary valve 6. The shape of this path creates a centrifugal flow toward the circumference of the rotary valve 6 from the center of the shaft (rotary valve 6). The air will flow in through the intake port 8 of shaft (rotary valve 6) to the circumference to create pressure as depicted in FIG. 13.

Other novel features of the invention include stacking the cylinder banks to increase the engine capacity. This will keep the same flywheel diameter. Compared to increasing the bore and stroke which will increase the flywheel diameter. With a 4 cylinder 2 cycle engine the combustion is every 90 degrees. An 8 cylinder 2 cycle engine will have combustion every 45 degrees. An integrated rotary valve supplies both banks of cylinders.

The invention is an improvement to the first patent application. The first patent covers multiple cylinders around a common valve. When the increase in capacity is desired, this instant invention allows for increase in number of cylinders, bore diameter, and stroke length. Changing any one of these items will change the diameter of the rotary valve.

The rotary valve is also the drive shaft and flywheel. There is a preferred amount of stored kinetic energy of the system that is most influenced by the flywheel. There are several factors that go into determining the proper flywheel inertia; i.e. weight of the vehicle, acceleration, deceleration, transmission, etc. The inertia of a flywheel is $$I=\Pi/32*\rho*t*d4$$

ρ=density of the material t=thickness of the rotary valve d=diameter of the rotary valve The diameter thus influences the inertia to the fourth power.

Figure 18:
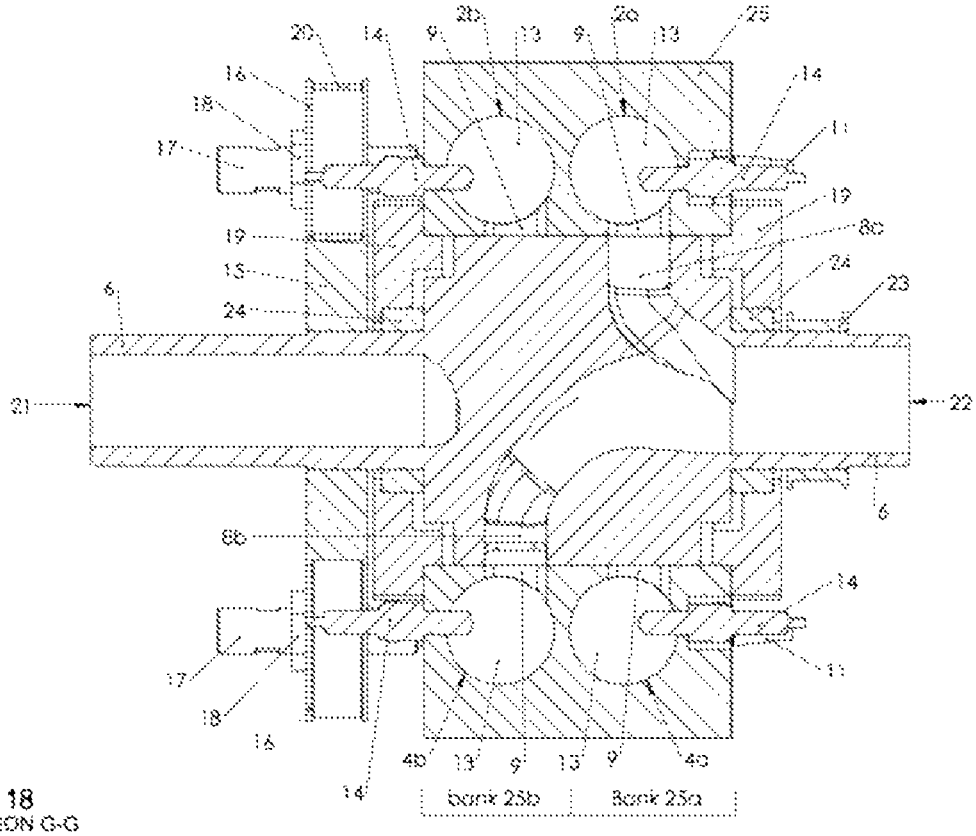
FIG. 18 depicts a sectional view taken from an end through line G-G of FIG. 17.

More particularly, described now are the detailed components of the invention. The invention is based on a common intake port 22, in a preferred embodiment a first internal intake port 8A and a second internal intake port 8B as seen in FIG. 18, and exhaust port 7 of a rotary valve 6 that is centrally located within a cylinder block 25 which in a preferred embodiment can have multiple cylinder bank body 25 as seen in FIG. 18 to supply multiple cylinders 2*a*, 3*a*, 4*a*, 5*a*, 2*b*, 3*b*, 4*b*, and 5*b*. The exhaust port 7 and intake port 8 communicate from respective first and second ends (21, 22) of the rotary valve 6 to a common transport port 9 on each of the cylinders, 2*a*, 3*a*, 4*a*, 5*a*, 2*b*, 3*b*, 4*b*, and 5*b*. Ends of exhaust port 21 and intake port 22 of the rotary valve 6 also serve as the output shaft of the engine 101. The central portion of the rotary valve 6 is of a sufficient size and serves as a flywheel. As discussed above, by varying the configuration of the rotary valve 6, the inertia is changed and performance as well. Adding additional cylinder banks 25*a* and 25*b* provides for reduced inertia. Stacking the cylinder banks 25*a* and 25*b* while keeping the bore and stroke the same will double the engine capacity. Compared to increasing the engine capacity by increasing the bore and stroke, which will increase the flywheel diameter and inertia. With a 4 cylinder 2 cycle engine the combustion is every 90 degrees. An 8 cylinder 2 cycle engine will have combustion every 45 degrees. An integrated rotary valve supplies both banks 25*a* and 25*b* of multiple cylinders bank body 25.

Figure 15:
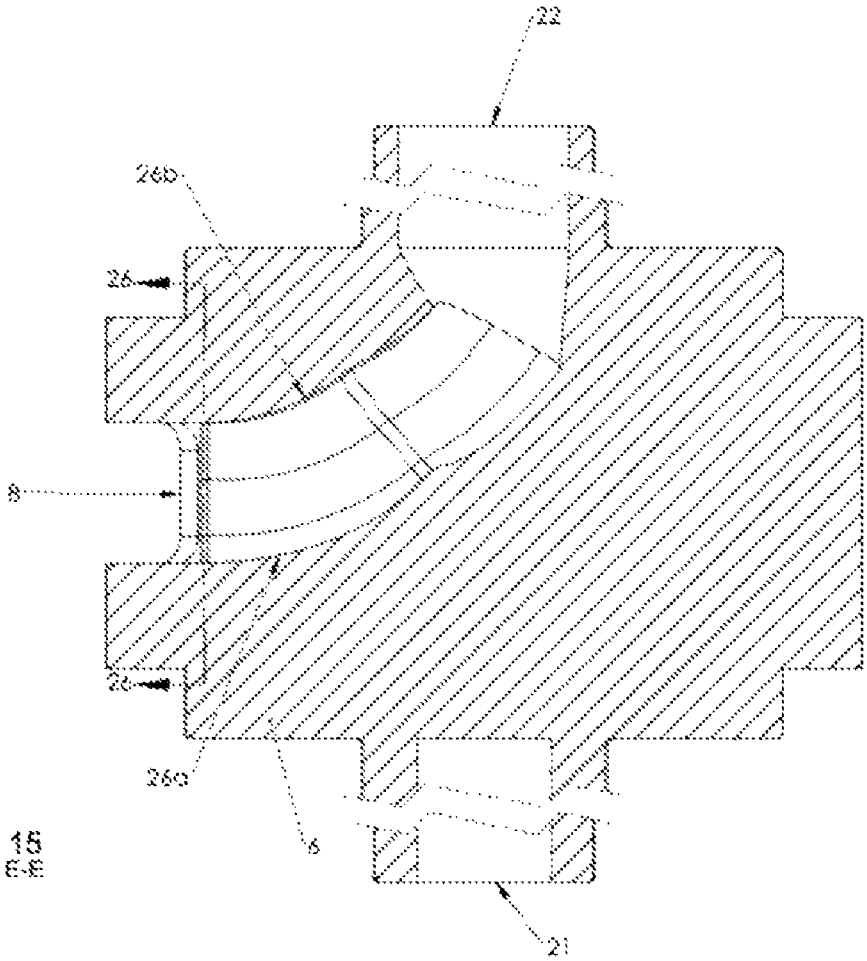
FIG. 15 depicts a sectional view taken from an end through line E-E of FIG. 14.
Figure 16:
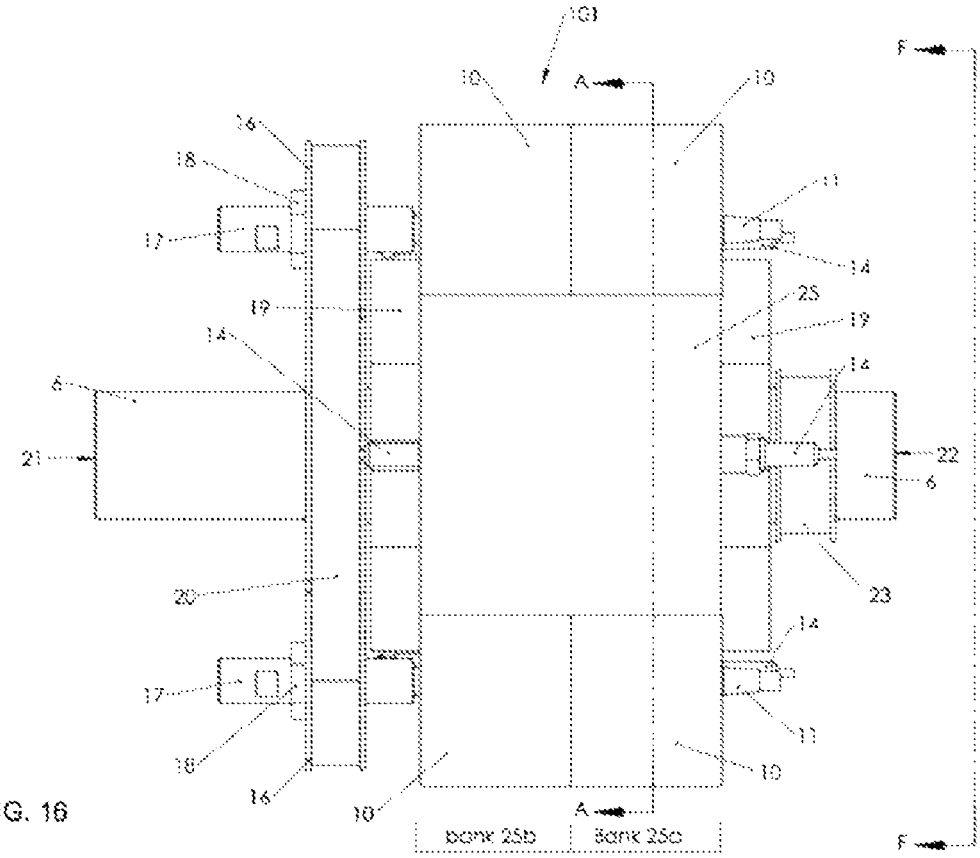
FIG. 16 depicts a side view of the invention.
Figure 17:
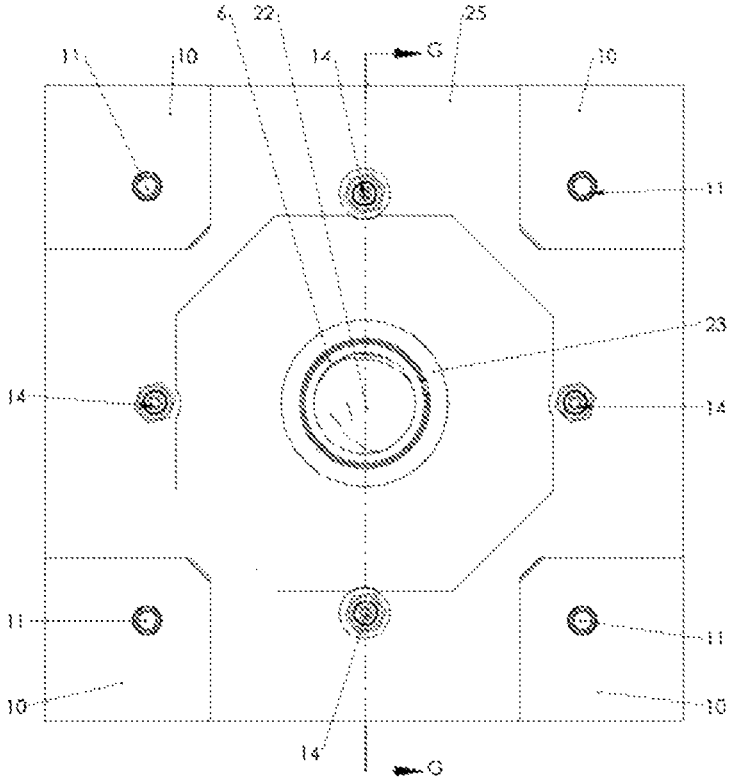
FIG. 17 depicts an end view of the invention from line F-F of FIG. 16.

The configuration of the cylinders 2*a*, 3*a*, 4*a*, 5*a*, 2*b*, 3*b*, 4*b*, and 5*b* on the instant design can preferably include two sets of opposed piston cylinders 2 and 4 and 3 and 5 aligned tangents to the rotary valve 6 in one cylinder bank 25. Further, the piston cylinders 2 and 4 generally share a common plane through their center axis and are in an offset relation to piston cylinders 3 and 5 which generally share a common plane through their center axis. This arrangement enables connecting rods 12 to cooperatively connect to crank shaft 11 and operate pistons 13 in the cylinders 2*a*, 3*a*, 4*a*, 5*a*, 2*b*, 3*b*, 4*b*, and 5*b*. The crank shafts 11 are operably connected to the ends 21 and 22 of the rotary valve 6 to affect the transfer of power. In this regard, the intake valve port 8 and exhaust valve port 7 can preferably be configured with a trapezoidal shape through the curved section 26 of FIG. 15 of the rotary valve 6 which will reduce the flow losses that are common to a round configuration. The outer radius 26*a* on the curved port 8 is small which increased the flow on the outer wall to match the longer distance the air mass travels versus the inter wall 26*b* distance.

The curved exhaust path 27 of the instant invention as seen in FIG. 12 is designed to create a vacuum at the outer circumference of the rotary valve 6. The shape of the path creates a flow away from the circumference to the center of the rotary valve 6. The air will exhaust out through the exhaust port 21. A straight port going from the center of the rotary valve 6 to the circumference would create airflow by the nature of exhausting the cylinders. With the rotation of rotary valve 6 having curved exhaust path 27 trailing a straight line path to the circumference of the valve, a vacuum is created. The curved shape of exhaust valve 27 also creates a scooping effect on the outer circumference of rotary valve 6.

Also, curved intake path 28 of the instant invention as seen in FIG. 13 is designed to create pressure at the outer circumference of the rotary valve 6. The shape of this path creates a flow toward the circumference of the rotary valve 6. The air will flow in through the intake port 22 to the center of the rotary valve 6 to the circumference to create pressure. A straight port going from the center of the rotary valve 6 to the circumference would create airflow by the nature of the intake process to the cylinders. With the rotation of rotary valve 6 having the curve of the intake path 28 leading a straight line path to the circumference of the valve, a centrifugal effect is created.

It is contemplated that a chain, gear or belt 20 can be employed on the crank shaft 11 to connect the end 21 by way of example. It is contemplated that plurality of interconnecting gears can be employed to carry out the intended purposes the drive mechanism which can manually or automatically adjust the pistons 13.

In particular, a drive shaft pulley 15 can be operably connected to the end 21 of rotary valve 6 which serves as the drive shaft. A crank shaft adapter 17 is operably connected to respective crank shaft 11. Operably connected about each of the crank shaft adapter 17 is a crank shaft pulley 16. A pulley coupling 18 operably couples each crank shaft adapter 17 to each respective crank shaft pulley 16. Drive shaft pulley 15 is operably disposed on end 21. Time belt 20 operably interconnects pulleys 15 and 16.

A drive shaft bearings 24 are operably disposed about ends 21 and 22 with bearings 24 being operably received in valve end covers 19. Additionally, a drive pulley 23 is operably disposed on end 22 and can likewise be connected to a set of pulleys to provide output.

The transfer port 9 in each cylinder 2, 3, 4, and 5 is located at the top of a piston stroke. The current illustration is a preferred embodiment and it is contemplated that more or less cylinders or alignments of the cylinders are contemplated. The cylinder 2, 3, 4, and 5 aligned radially to the rotary valve 6 is also a consideration. A spark plug 14 is operably disposed in each cylinder 2, 3, 4, and 5 adjacent the transfer port 9.

A benefit to the common rotary valve 6 of the instant invention is that the air intake port 8 would provide a near constant flow as it transitions from one cylinder to the next. This will reduce the reverberation generated with the rotary valve 6 closes. The engine can be 2-cycle or 4-cycle configuration. The advantage of the 2-cycle configuration is that in most 2-cycle configurations the exhaust port 7 is last to be closed on the cycle. This allows fresh air to escape through the exhaust and requires a tuned exhaust pipe to operate. 2-cycle engines also receive a charge of air from the crank case compression.

Figure 11:
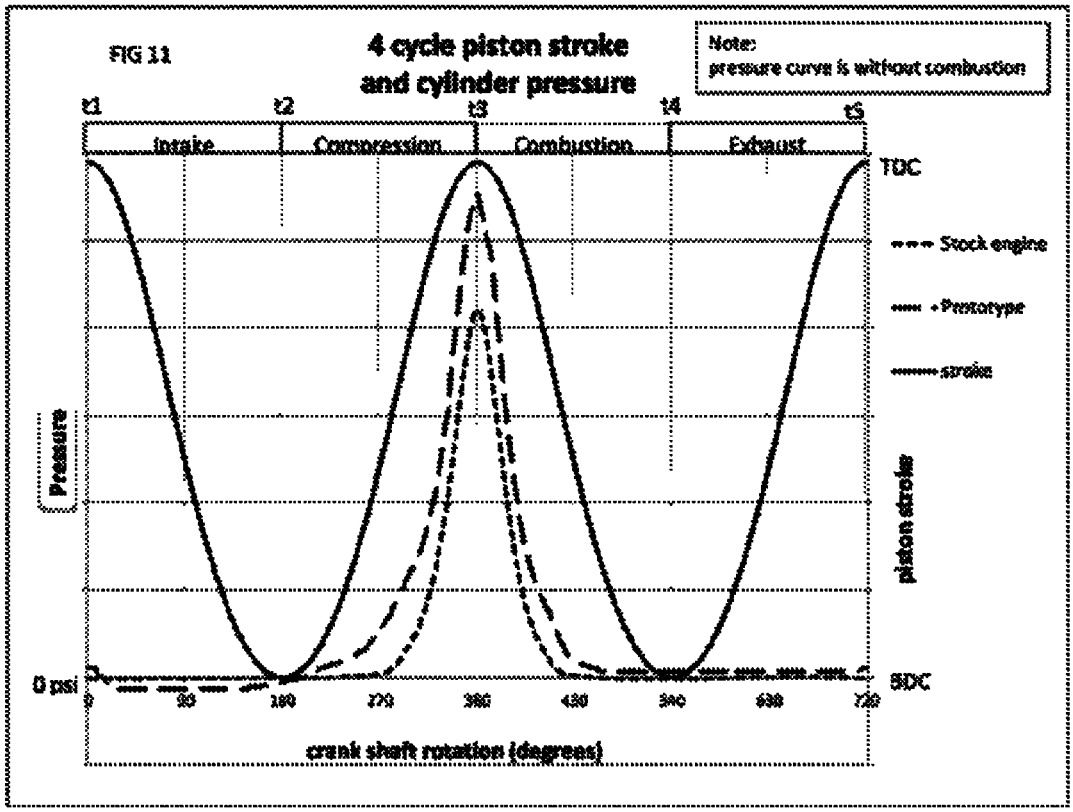
FIG. 11 depicts a pressure curve through one cycle of the invention.

The operation of the invention is as follows and is followed by viewing FIGS. 1-4 for example at the times shown therein. A complete cycle occurs from intake through exhaust (t.sub.1 and t.sub.5). As seen in FIG. 11, the pressure curve P1 represents the harmonic motion of the drive pistons 13 and the cylinder pressure created without ignition and combustion. The peaks and valleys of the curves represent the TDC and the BDC points, respectively, for the pistons 13. The pressure curve "stock engine" represents a naturally aspirated poppet valve 4 cycle engine. The pressure curve "prototype" represents the inventions improved ability to breath with less restriction. FIGS. 1-4 is representative of the 4 cycles of the engine for cylinder 2 and noted on the pressure curve. The space within cylinder 2 between pistons 13 is filled through intake port 8, 22 and transfer port 9 with fuel-air mixture during the period between t1 and t2 represented in FIG. 1 The fuel-air mixture is represented by small circles. The combustion and exhaust gases are represented dots. The period between t2 and t3 shows the compression of the volume of space and fuel-air mixture represented in FIG. 2 in cylinder 2.

Figure 6:
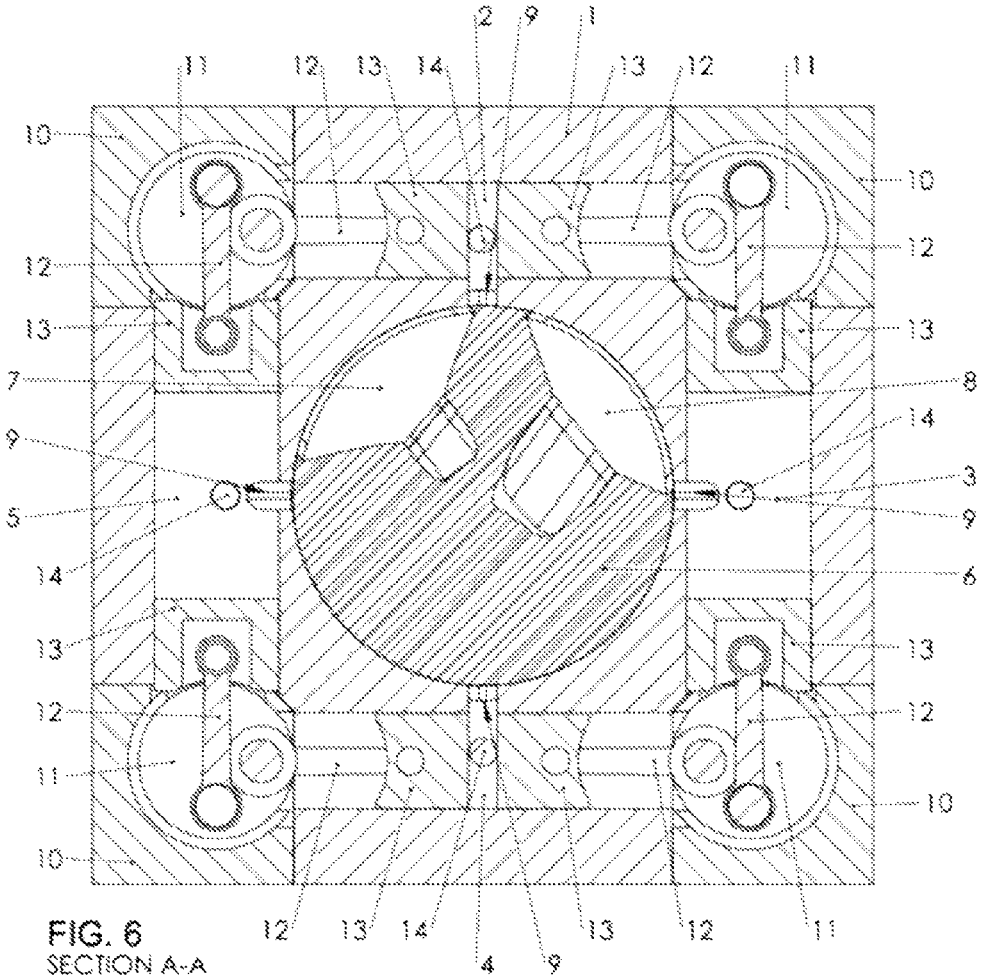
FIG. 6 depicts a sectional view taken from an end through line A-A of FIG. 5.
Figure 7:
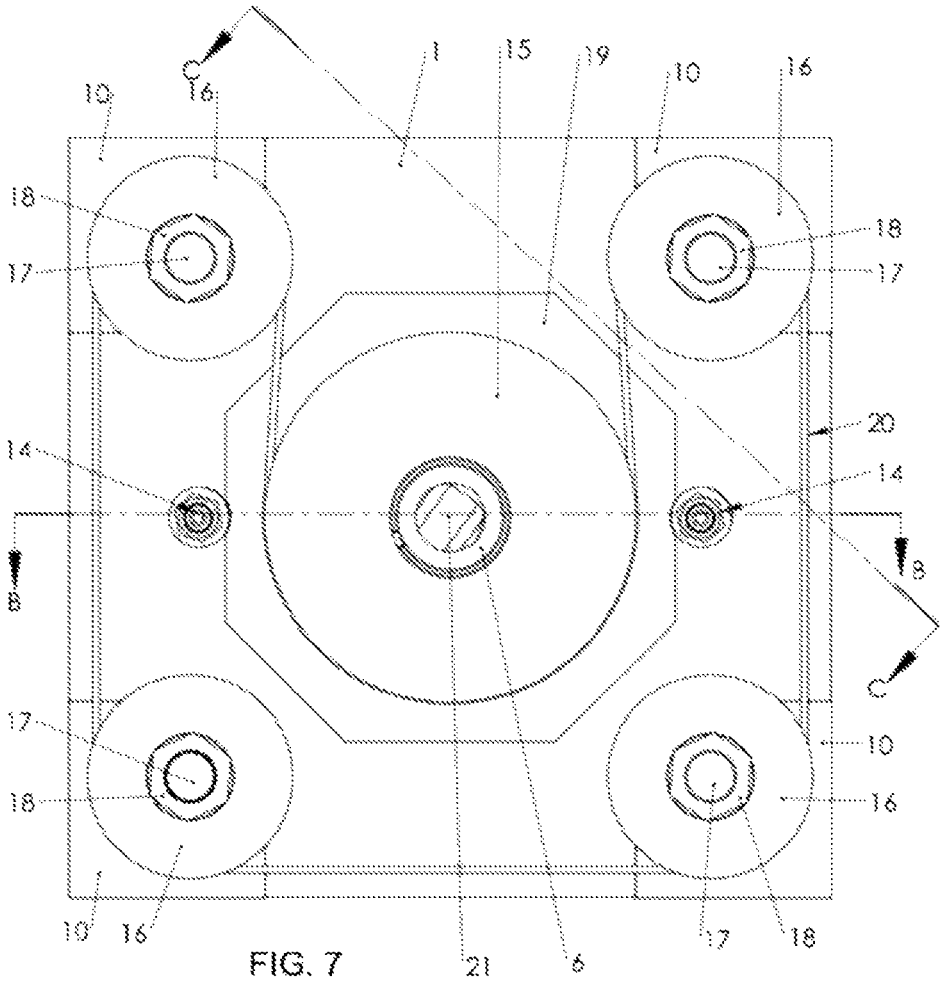
FIG. 7 depicts an end elevation view of the present invention.
Figure 8:
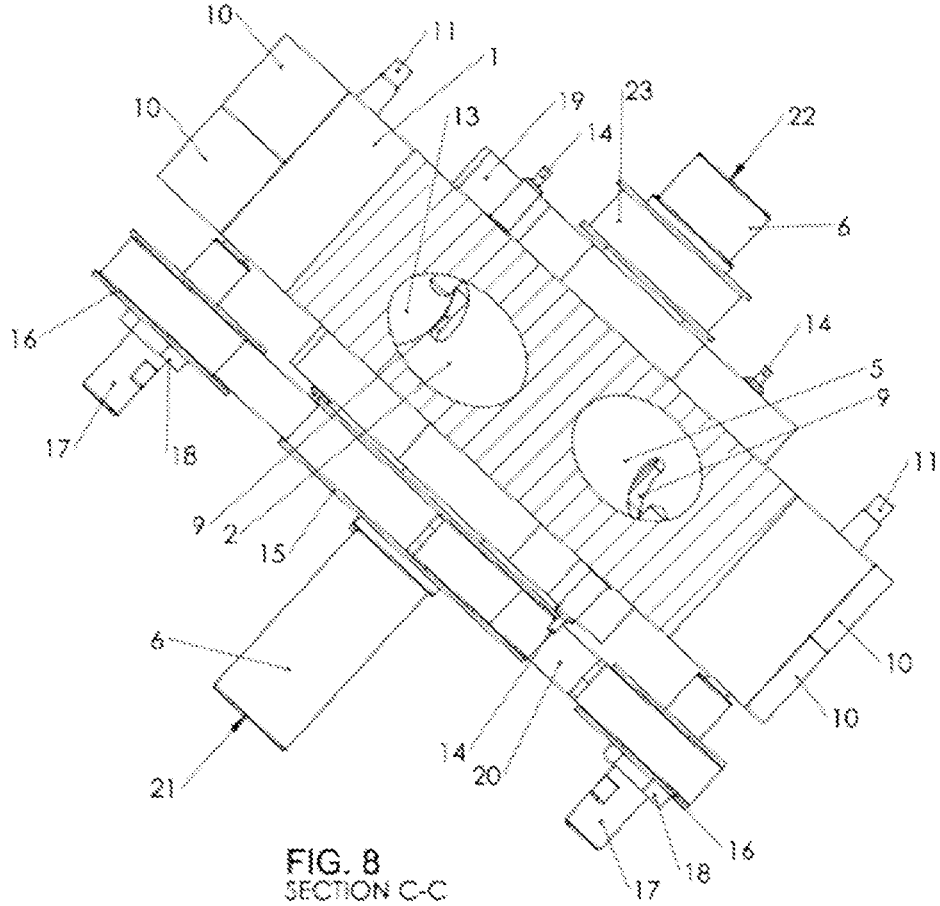
FIG. 8 depicts a sectional view taken through line C-C of FIG. 7.
Figure 9:
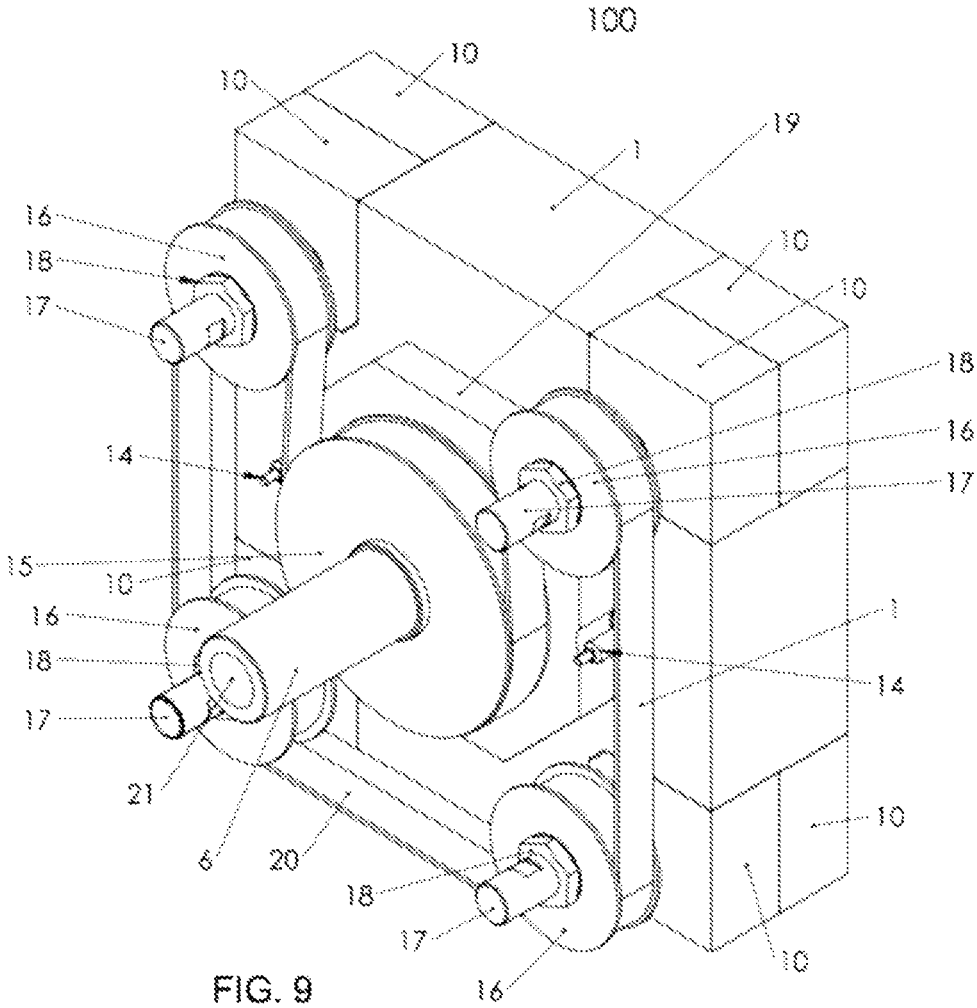
FIG. 9 depicts a perspective view of the invention.
Figure 10:
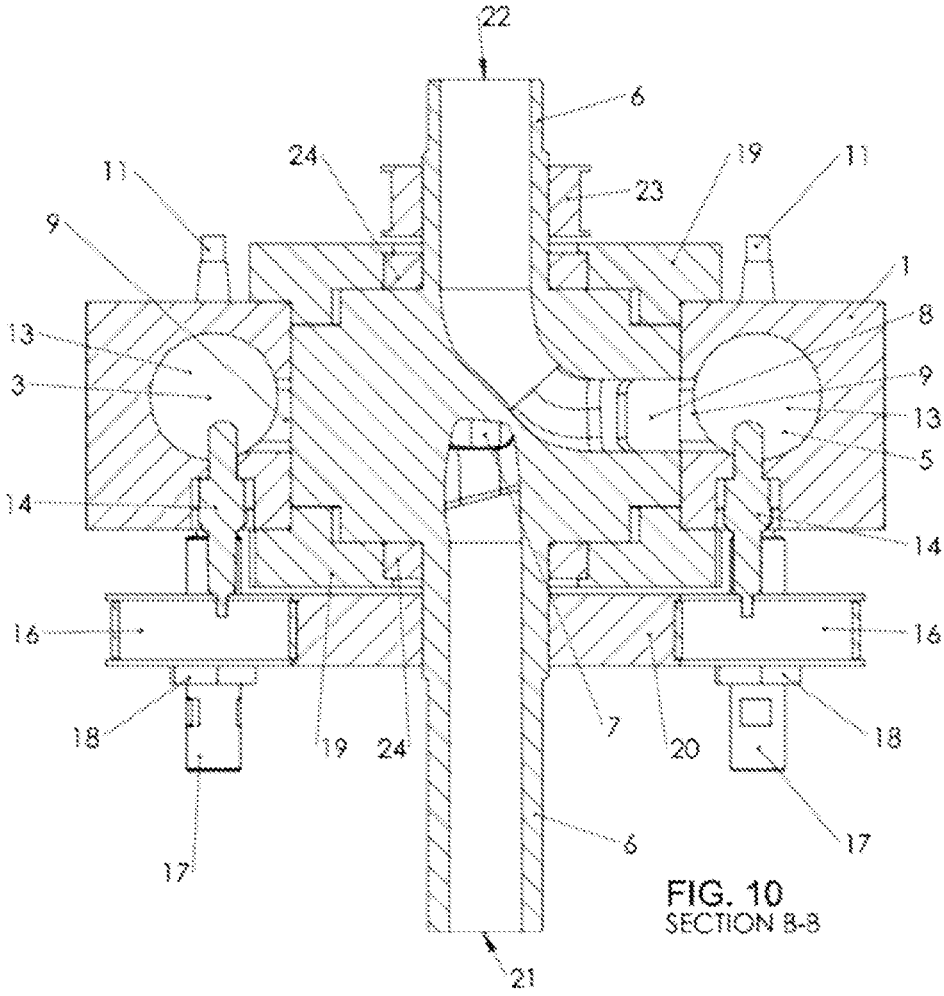
FIG. 10 depicts a sectional view taken from an end through line B-B of FIG. 9.

From the point t3 to t4 at approximately constant volume is represented in pressure curve P1 when there is no ignition. When ignition takes place the pressure in the cylinder increases 3 to 5 times and the maximum pressure takes place at approximately 15 degree after TDC. The pressure caused by the explosive forces of fuel-air mixture being ignited causes the pistons 13 to be driven away from one another. The space between the period t3 and t4 represents the power phase of the engine 100. The space between t4 and t5 represents an exhaust phase wherein the waste gas is removed through the transfer port 9 and exhaust port 7, 21. In FIG. 6, the rotary valve rotates counter-clockwise and the crank shafts rotate clockwise.

By so providing, the present invention has improved efficiencies in the internal combustion engine. The instant invention provides for significant performance improvement. The opposed piston configuration does not required a cylinder head which is a major contributor to heat losses in conventional engines. Conventional 4 cycle engines used poppet valves that restrict the air flow in and out of the cylinder. The valve train requires a significant amount of power to operate and limits the speed of the engine. The free flowing exhaust port helps the engine to run cooler. With the crank shafts connecting to two cylinders through the connecting rod and piston this assist the piston in the cylinder to compress the fuel-air mixture. The power stroke is transferred through two crank shafts that transfer the power to the drive shaft/rotary valve. By using the present invention the horse power will increase. The fuel efficiency will increase because there is better evacuation of the cylinder during the exhaust stroke and a full clean fuel-air mixture change can fill the cylinder.) The invention provides a flow path through the rotary valve which is designed to improve the flow and create pressure differentials in the direction of the engine air flow. Additionally, through the invention, when larger engine capacity is required the bore and stock can increase or add cylinders. Stacking cylinder banks reduces the inertia of the rotary valve, the oscillating components (piston and connecting rod) are smaller, and the crank shaft can be smaller and longer.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed:

1. An internal combustion engine which includes:

a first cylinder block part having at least a first cylinder therein which is tangentially disposed to and communicating with a first transfer port;

a first spark plug operably disposed in said first cylinder adjacent said first transfer port;

a rotary valve surface in communication with said first transfer port and wherein said first cylinder is laterally disposed to said rotary valve surface;

a rotary valve having a first end, a central portion and a second end, wherein said central portion is rotatably disposed within said rotary valve surface and has an intake port configured with to supply fuel to said first cylinder through said first transfer port and an exhaust port and remove exhaust gas from said first cylinder through said first transfer port, said intake port and exhaust port communicate through said first end and said second end, respectively, of said rotary valve to said first transport port upon rotation of said rotary valve;

a first piston reciprocally disposed within said first cylinder;

a first crank case operably disposed adjacent said first cylinder having a first crank shaft receiving surface; and a first crank shaft operably disposed in said first crank shaft receiving surface, said first crank shaft operably connected to said first piston by a first connecting rod and said first crank shaft operably connected to at least one end of said rotary valve such that said rotary valve serves as an output shaft for said engine.

2. The internal combustion engine of claim 1, wherein said central portion of said rotary valve serves as a flywheel.

3. The internal combustion engine of claim 1, which further includes:

a second piston reciprocally disposed within said first cylinder;

a second crank case operably disposed adjacent said first cylinder having a second crank shaft receiving surface; and a second crank shaft operably disposed in said second crank shaft receiving surface, said second crank shaft operably connected to said second piston by a second connecting rod and said second crank shaft operably connected to at least one end of said rotary valve to further aid said output shaft for said engine.

4. The internal combustion engine of claim 3, wherein said central portion of said rotary valve serves as a flywheel.

5. The internal combustion engine of claim 1, which further characterized to include:

a second cylinder block part having a second cylinder therein which is tangentially disposed to and communicating with a second transfer port;

a second spark plug operably disposed in said second cylinder adjacent said second transfer port;

a rotary valve surface in communication with said second transfer port and wherein said second cylinder is laterally disposed to second rotary valve surface;

said intake port to supply fuel to said second cylinder through said second transfer port and said exhaust port and remove exhaust gas from said second cylinder through said second transfer port;

a second piston reciprocally disposed within said second cylinder;

a second crank case operably disposed adjacent said second cylinder having a second crank shaft receiving surface; and a second crank shaft operably disposed in said second crank shaft receiving surface, said second crank shaft operably connected to said second piston by a second connecting rod and said second crank shaft operably connected to at least one end of said rotary valve such to further aid said output shaft for said engine.

6. The internal combustion engine of claim 5, wherein said central portion of said rotary valve serves as a flywheel.

7. The internal combustion engine of claim 1, which further characterized to include:

a second cylinder block part having a second cylinder therein which is tangentially disposed to and communicating with a second transfer port;

a second spark plug operably disposed in said second cylinder adjacent said second transfer port;

a rotary valve surface in communication with said second transfer port and wherein said second cylinder is laterally disposed to second rotary valve surface;

said intake port to supply fuel to said second cylinder through said second transfer port and said exhaust port and remove exhaust gas from said second cylinder through said second transfer port;

a second piston reciprocally disposed within said second cylinder; and said first crank shaft operably connected to said second piston by a second connecting rod.

8. The internal combustion engine of claim 7, wherein said central portion of said rotary valve serves as a flywheel.

9. The internal combustion engine of claim 1, which further characterized to include:

a second piston reciprocally disposed within second first cylinder; and said first crank shaft operably connected to said second piston by a second connecting rod.

10. The internal combustion engine of claim 9, wherein said central portion of said rotary valve serves as a flywheel.

11. The internal combustion engine of claim 1, which further characterized to include two sets of opposed cylinders and pistons therein aligned generally tangent to said rotary valve, wherein a first set of opposing cylinders and pistons generally share a common plane through their center axis and are in an offset relation to a second set of piston cylinders and pistons which generally share a common plane through their center axis.

12. The internal combustion engine of claim 1, which further includes a valve plate cover for retaining said rotary valve within said rotary valve surface.

13. The internal combustion engine of claim 1, which further includes a drive mechanism interconnecting said first crank shaft and said output shaft.

14. The internal combustion engine of claim 1, wherein at least one said port is configured with an arcuate shape which is curved in a complementary direction to foster air flow therethrough.

15. The internal combustion engine of claim 14, wherein said central portion of said rotary valve serves as a flywheel.

16. The internal combustion engine of claim 15, wherein said exhaust port is configured with a trapezoidal cross section.

17. The internal combustion engine of claim 1, wherein at least one said port is configured with a trapezoidal cross section.

18. The internal combustion engine of claim 1, wherein said exhaust port is configured with an arcuate shape which is curved in a complementary direction to foster air flow through said exhaust port.

19. The internal combustion engine of claim 1, wherein said intake port is configured with an arcuate shape which is curved in a complementary direction to foster air flow through said intake port.

20. The internal combustion engine of claim 19, wherein said exhaust port is configured with a trapezoidal cross section.

21. An internal combustion engine which includes:

a plurality of cylinder banks wherein each bank includes a first cylinder block part having at least a first cylinder therein which is tangentially disposed to and communicating with a first transfer port, a first spark plug operably disposed in said first cylinder adjacent said first transfer port;

a rotary valve surface in communication with each said first transfer port and wherein each said first cylinder is laterally disposed to said rotary valve surface;

a rotary valve having a first end, a central portion and a second end, wherein said central portion is rotatably disposed within said rotary valve surface and has a primary intake port communicably connected to a plurality of internal intake ports to supply fuel to each said first cylinder through each said first transfer port and has a primary exhaust port plurality of communicably connected to a plurality of internal exhaust ports which remove exhaust gas from said each respective first cylinder through each said first transfer port, each said intake port and each said exhaust port communicate through said first end and said second end, respectively, of said rotary valve to each said respective first transport port upon rotation of said rotary valve;

a first piston reciprocally disposed within each said first cylinder;

a first crank case operably disposed adjacent each said first cylinder having a first crank shaft receiving surface; and a first crank shaft operably disposed in each first said crank shaft receiving surface, each said first crank shaft operably connected to each respective said first piston by a first connecting rod and each said first crank shaft operably connected to at least one end of said rotary valve such that said rotary valve serves as an output shaft for said engine.

22. The internal combustion engine of claim 21, wherein said central portion of said rotary valve serves as a flywheel.

23. The internal combustion engine of claim 21, which further includes:

a second piston reciprocally disposed within each said first cylinder;

a second crank case operably disposed adjacent each said first cylinder having a second crank shaft receiving surface; and a second crank shaft operably disposed in said second crank shaft receiving surface, said second crank shaft operably connected to said second piston by a second connecting rod and said second crank shaft operably connected to at least one end of said rotary valve to further aid said output shaft for said engine.

24. The internal combustion engine of claim 23, wherein said central portion of said rotary valve serves as a flywheel.

25. The internal combustion engine of claim 21, wherein each said bank is further characterized to include:

a second cylinder block part having a second cylinder therein which is tangentially disposed to and communicating with a second transfer port;

a second spark plug operably disposed in said second cylinder adjacent said second transfer port;

a rotary valve surface in communication with said second transfer port and wherein said second cylinder is laterally disposed to second rotary valve surface;

said intake port to supply fuel to said second cylinder through said second transfer port and said exhaust port and remove exhaust gas from said second cylinder through said second transfer port;

a second piston reciprocally disposed within said second cylinder;

a second crank case operably disposed adjacent said second cylinder having a second crank shaft receiving surface; and a second crank shaft operably disposed in said second crank shaft receiving surface, said second crank shaft operably connected to said second piston by a second connecting rod and said second crank shaft operably connected to at least one end of said rotary valve such to further aid said output shaft for said engine.

26. The internal combustion engine of claim 25, wherein said central portion of said rotary valve serves as a flywheel.

27. The internal combustion engine of claim 21, wherein each said bank is further characterized to include:

a second cylinder block part having a second cylinder therein which is tangentially disposed to and communicating with a second transfer port;

a second spark plug operably disposed in said second cylinder adjacent said second transfer port;

a rotary valve surface in communication with said second transfer port and wherein said second cylinder is laterally disposed to second rotary valve surface;

said intake port to supply fuel to said second cylinder through said second transfer port and said exhaust port to remove exhaust gas from said second cylinder through said second transfer port;

a second piston reciprocally disposed within said second cylinder; and said first crank shaft operably connected to said second piston by a second connecting rod.

28. The internal combustion engine of claim 27, wherein said central portion of said rotary valve serves as a flywheel.

29. The internal combustion engine of claim 21, which further characterized to include:

a second piston reciprocally disposed within each second first cylinder; and said first crank shaft operably connected to said second piston by a second connecting rod.

30. The internal combustion engine of claim 29, wherein said central portion of said rotary valve serves as a flywheel.

31. The internal combustion engine of claim 21, which further characterized to include two sets of opposed cylinders and pistons therein aligned generally tangent to said rotary valve, wherein a first set of opposing cylinders and pistons generally share a common plane through their center axis and are in an offset relation to a second set of piston cylinders and pistons which generally share a common plane through their center axis.

32. The internal combustion engine of claim 31, wherein said central portion of said rotary valve serves as a flywheel.

33. The internal combustion engine of claim 21, which further includes a valve plate cover for retaining said rotary valve within said rotary valve surface.

34. The internal combustion engine of claim 33, wherein said central portion of said rotary valve serves as a flywheel.

35. The internal combustion engine of claim 21, which further includes a drive mechanism interconnecting said first crank shaft and said output shaft.

36. The internal combustion engine of claim 35, wherein said central portion of said rotary valve serves as a flywheel.

37. The internal combustion engine of claim 21, wherein at least one said port is configured with an arcuate shape which is curved in a complementary direction to foster air flow therethrough.

38. The internal combustion engine of claim 21, wherein at least one said port is configured with a trapezoidal cross section.

* * * * *